US011474470B2

(12) United States Patent
Yamashita

(10) Patent No.: US 11,474,470 B2
(45) Date of Patent: Oct. 18, 2022

(54) SHEET FEEDING APPARATUS AND IMAGE FORMING APPARATUS

(71) Applicant: CANON KABUSHIKI KAISHA, Tokyo (JP)

(72) Inventor: Fuyuto Yamashita, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/887,201

(22) Filed: May 29, 2020

(65) Prior Publication Data

US 2020/0387103 A1 Dec. 10, 2020

(30) Foreign Application Priority Data

Jun. 5, 2019 (JP) ..... JP2019-105657

(51) Int. Cl.
*G03G 15/00* (2006.01)
*G03G 21/16* (2006.01)
(Continued)

(52) U.S. Cl.
CPC ..... *G03G 15/6567* (2013.01); *B65H 5/062* (2013.01); *B65H 7/02* (2013.01);
(Continued)

(58) Field of Classification Search
CPC ..... G03G 15/6567; G03G 15/607; G03G 15/6508; G03G 15/80; G03G 21/1647;
(Continued)

(56) References Cited

U.S. PATENT DOCUMENTS 3,395,914 A * 8/1968 Buccicone ..... B65H 29/30 271/193
4,908,673 A * 3/1990 Muramatsu ..... G03G 15/234 271/171

(Continued)

FOREIGN PATENT DOCUMENTS

CN 101024453 A 8/2007
JP H05-294462 A 11/1993

(Continued)

OTHER PUBLICATIONS

Chinese Office Action dated Jul. 6, 2022, in related Chinese Patent Application No. 202010487375.0 (with English translation).

*Primary Examiner* — David H Banh
(74) *Attorney, Agent, or Firm* — Venable LLP

(57) ABSTRACT

A sheet feeding apparatus includes a supporting portion to support a sheet, a feeding portion to feed the supported sheet, and a base member opposed to the supporting portion so the sheet is supported by the supporting portion between the supporting portion and the base member. A regulation unit includes a regulation portion to regulate a position of an edge portion of the supported sheet and moves in a moving direction, and a sensor outputs an output value that changes in accordance with an amount of movement of the regulation unit. The sensor and the regulation unit are supported by the base member, and the sensor is supported by the base member at a position above an abutment position between the sheet supported by the supporting portion and the feeding portion in a gravity direction.

17 Claims, 9 Drawing Sheets

(51) Int. Cl.
*B65H 7/02* (2006.01)
*B65H 5/06* (2006.01)
*B65H 9/08* (2006.01)

(52) U.S. Cl.
CPC ..... *B65H 9/08* (2013.01); *G03G 15/607* (2013.01); *G03G 15/6508* (2013.01); *G03G 15/80* (2013.01); *G03G 21/1647* (2013.01); *G03G 21/1652* (2013.01); *B65H 2403/411* (2013.01); *B65H 2404/74* (2013.01); *B65H 2553/81* (2013.01); *G03G 2215/00611* (2013.01); *G03G 2215/00721* (2013.01); *G03G 2215/00734* (2013.01); *G03G 2221/1657* (2013.01)

(58) Field of Classification Search
CPC ..... G03G 21/1652; G03G 2215/00611; G03G 2215/00721; G03G 2215/00734; G03G 2221/1657; B65H 5/062; B65H 7/02; B65H 9/08; B65H 2403/411; B65H 2404/74; B65H 2553/81
See application file for complete search history.

(56) References Cited

U.S. PATENT DOCUMENTS 5,333,852 A * 8/1994 Milillo ..... B65H 1/04 271/171
5,573,236 A * 11/1996 Petocchi ..... G03G 15/6502 271/265.02
6,070,048 A * 5/2000 Nonaka ..... B65H 1/00 399/376
6,543,761 B2 * 4/2003 Endo ..... B65H 3/5223 271/110
6,619,656 B2 * 9/2003 Guddanti ..... B65H 1/04 271/171
7,854,427 B2 12/2010 Tsujinishi
9,302,860 B2 * 4/2016 Hirose ..... B65H 1/04
10,459,394 B2 10/2019 Morita
2007/0063425 A1 * 3/2007 Tsujinishi ..... B65H 9/08 271/145
2007/0194517 A1 8/2007 Nose et al.
2011/0158729 A1 * 6/2011 Lee ..... G03G 15/5062 400/578
2012/0117814 A1 * 5/2012 Marumoto ..... B65H 1/266 33/555
2012/0187622 A1 * 7/2012 Kamichi ..... B65H 3/0684 271/171
2020/0283248 A1 * 9/2020 Mitsui ..... B65H 1/04

FOREIGN PATENT DOCUMENTS

JP H06-9064 A 1/1994
JP H11-130271 A 5/1999
JP H11-314801 A 11/1999
JP 2001-322723 A 11/2001
JP 2007-084306 A 4/2007
JP 2008-132613 A 6/2008
JP 2017-047988 A 3/2017
JP 2018-052731 A 4/2018

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets and an image forming apparatus including the sheet feeding apparatus.

Description of the Related Art

In recent years, a known image forming apparatus forms images on sheets with a variety of sizes, and includes a sensor for detecting a size of sheets. For example, Japanese Patent Application Publication No. H6-9064 discloses a technique that detects a size of sheets by detecting the amount of movement of a sheet regulation unit that regulates the position of the sheets, stacked on a sheet feeding tray, in a sheet width direction. In addition, Japanese Patent Application Publication No. 2018-52731 discloses a configuration that includes a regulation plate (cursor) and a sensor. The regulation plate includes a positioning portion that positions sheets, stacked on a stacking plate, in a sheet width direction; and a rack portion that extends along the sheet width direction. The sensor is disposed so as to face the rack portion. In the configuration of Japanese Patent Application Publication No. 2018-52731, a plurality of portions to be detected and having different optical properties are disposed on the rack portion along the sheet width direction, and the size of the sheets in the sheet width direction is identified, depending on output signals from the portions.

In Japanese Patent Application Publication Nos. H6-9064 and 2018-52731, however, since the sensor and the portions for detecting a sheet size are disposed below the stacking plate and the cursor, paper dust and foreign substance may fall from the stacking plate and the regulation plate, possibly causing wrong detection of sheet size.

SUMMARY OF THE INVENTION

The present disclosure provides a sheet feeding apparatus that can prevent the wrong detection of the sheet size, and an image forming apparatus including the sheet feeding apparatus.

According to one aspect of the present invention, a sheet feeding apparatus includes: a supporting portion configured to support a sheet: a feeding portion configured to feed the sheet supported by the supporting portion; a regulation unit comprising a regulation portion configured to regulate a position of an edge portion of the sheet supported by the supporting portion, the regulation unit being configured to move in a moving direction and cause the regulation portion to regulate a position of the edge portion of the sheet in the moving direction; and a sensor configured to output an output value that changes in accordance with an amount of movement of the regulation unit in the moving direction. The sensor is disposed above the supporting portion and the regulation portion in a gravity direction, and above an abutment position between the sheet supported by the supporting portion and the feeding portion in the gravity direction.

Further features of the present invention will become apparent from the following description of exemplary embodiments with reference to the attached drawings.

DESCRIPTION OF THE EMBODIMENTS

Overall Configuration of Image Forming Apparatus

Figure 1:
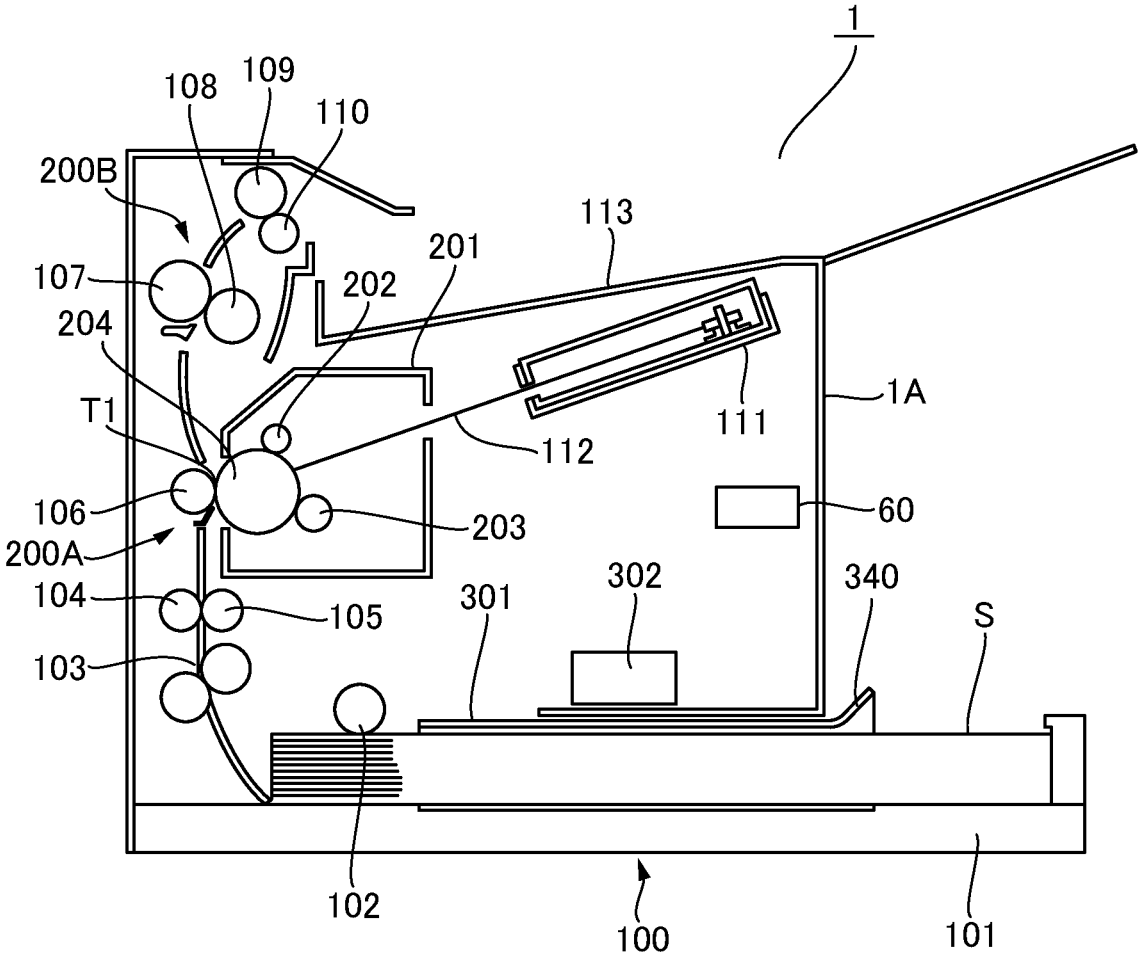
FIG. 1 is a diagram schematically illustrating a configuration of a printer of an embodiment of the present disclosure.

A printer 1 of an embodiment of the present disclosure, which serves as an image forming apparatus, is an electrophotographic laser-beam printer that forms monochrome toner images. As illustrated in FIG. 1, the printer 1 includes a sheet feeding apparatus 100 that feeds a sheet S, an image forming portion 200A that forms an image on the fed sheet S, a fixing apparatus 200B, discharging rollers 109 and 110, and a control unit 60. The control unit 60 includes a CPU (Central Processing Unit), a ROM (Read Only Memory), and a RAM (Random Access Memory) (these components are not illustrated in the figure); and drives and controls each component of the printer 1.

When an image forming instruction is outputted to the printer 1, the printer 1 causes the image forming portion 200A to start an image forming process, in accordance with image information inputted into the printer from, for example, an external computer connected to the printer 1. The image forming portion 200A includes a process cartridge 201, a laser scanner 111, and a transfer roller 106.

The process cartridge 201 includes a photosensitive drum 204 that can rotate, a charging roller 202, a developing roller 203, and a cleaning blade. The charging roller 202, the developing roller 203, and the cleaning blade are disposed around the photosensitive drum 204. The transfer roller 106 and the photosensitive drum 204 form a transfer nip T1. Note that although the printer 1 is a monochrome laser beam printer in the present embodiment, the present disclosure is not limited to this. For example, the printer 1 may be a full-color laser-beam printer, or may be another image forming apparatus, such as an ink-jet printer, other than the electrophotographic device.

The laser scanner 111 emits a laser beam 112 to the photosensitive drum 204 in accordance with the inputted image information. The photosensitive drum 204 is charged in advance by the charging roller 202. Thus, when the laser beam 112 is emitted to the photosensitive drum 204, an electrostatic latent image is formed on the photosensitive drum 204. The electrostatic latent image is then developed by the developing roller 203, and a monochrome toner image is formed on the photosensitive drum 204.

In parallel with the above-described image forming process, the sheet S is fed from the sheet feeding apparatus 100. The sheet feeding apparatus 100 includes a feeding tray 101 that serves as a supporting portion, a pickup roller 102 that serves as a feeding portion, a pair of regulation plates 301 that regulates the sheet S supported by the feeding tray 101, and a sensor unit 302. The feeding tray 101 may be supported by an apparatus body 1A such that the apparatus body 1A is opened or closed by the feeding tray 101. In this case, when the apparatus body 1A is closed, the feeding tray 101 forms one portion of the front surface of the exterior of the apparatus body 1A. On the other hand, when the apparatus body 1A is opened by the feeding tray 101, a user can access a sheet storing space of the apparatus body 1A. The sensor unit 302 is disposed above an abutment position between the sheets supported by the feeding tray 101 and the pickup roller 102, in the gravity direction.

The feeding tray 101 may be a feeding cassette 308 (see FIG. 9A) that is attached to or drawn from the apparatus body 1A. Each regulation plate 301 includes a regulation portion that regulates a position of an edge portion of each sheet. The regulation plate 301 has a sloping surface 340 formed at an end portion of the regulation plate 301 on the upstream side in an insertion direction of the sheet S. The sloping surface 340 slopes downward as the sloping surface 340 extends downstream in the insertion direction of the sheet S. The sloping surface 340 serves as a guide portion that guides the sheet S when the sheet S is inserted into the apparatus body 1A. In addition to the sloping surface 340 of FIG. 1, the regulation plate 301 may have another sloping surface formed at the end portion of the regulation plate 301 on the upstream side in the insertion direction of the sheet S, such that the sloping surface slopes toward the regulation portion of the regulation plate 301 as the sloping surface extends downstream in the insertion direction of the sheet S.

In response to an image forming instruction, the pickup roller 102 rotates, and the sheet S supported by the feeding tray 101 is fed by the pickup roller 102. The sheet S fed by the pickup roller 102 is separated from others, one by one, by a separation mechanism 103. Note that the sheet S may be fed by another component, such as a belt, in place of the pickup roller 102.

The sheet S separated one by one is then conveyed to registration rollers 104 and 105, and the skew of the sheet S is corrected by the registration rollers 104 and 105. The sheet S is then conveyed by the registration rollers 104 and 105 at a predetermined conveyance timing, and a toner image on the photosensitive drum 204 is transferred onto the sheet S in the transfer nip T1, by an electrostatic load bias applied to the transfer roller 106. The toner left on the photosensitive drum 204 is removed by the cleaning blade.

The sheet S onto which the toner image has been transferred is then applied with predetermined heat and pressure by a heating roller 108 and a pressure roller 107 of the fixing apparatus 200B, and thereby the toner is melted and solidified (fixed). The sheet S passes through the fixing apparatus 200B, and is discharged to a discharging tray 113 by discharging rollers 109 and 110.

Operation of Sensor

Figure 2A:
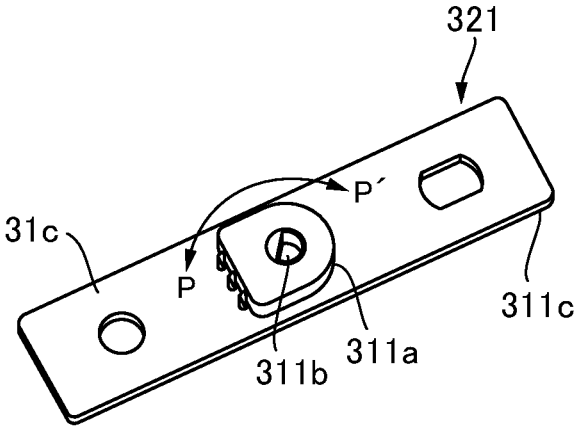
FIG. 2A is a diagram illustrating a rotary sensor of an embodiment of the present disclosure.
Figure 2B:
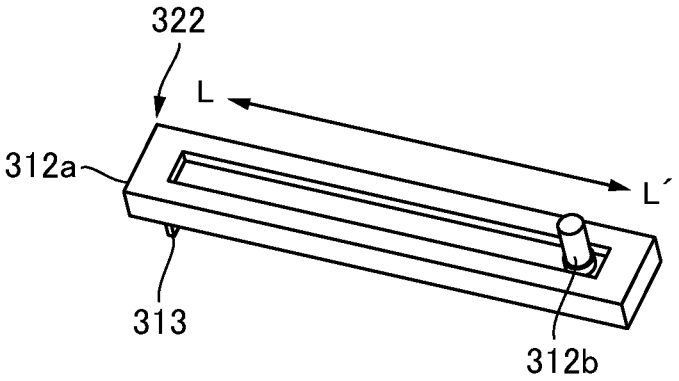
FIG. 2B is a diagram illustrating a slide sensor of an embodiment of the present disclosure.

Next, with reference to FIGS. 2A and 2B, an operation of a sensor of the embodiment of the present discloser will be described. The sensor detects a sheet size. FIG. 2A is a perspective view of a rotary sensor 321, and FIG. 2B is a perspective view of a slide sensor 322. First, with reference to FIG. 2A, a configuration of the rotary sensor 321 will be described. The sensor 321 includes a sensor body 311*a*, a shaft member 311*b*, and a board 311*c*. The shaft member 311*b* is rotatably supported by the sensor body 311*a*. The board 311*c* has a pattern surface 31*c* on which an electric circuit is formed and connected with the sensor body 311*a*. The shaft member 311*b* has a D-shaped hole, which engages with a D-cut shaft member such that the shaft member 311*b* rotates with the D-cut shaft member. In the first embodiment, the D-cut shaft member is formed integrally with a size-detecting pinion 302*b* (see FIG. 3). The sensor body 311*a* houses a resistor (not illustrated), and converts a resistance value of the resistor to a voltage and outputs the voltage. The output voltage, which is an output value from the sensor 321, changes in accordance with the amount of movement (the amount of rotation) of the shaft member 311*b* in a range between P and P'. In the present disclosure, the control unit 60 determines the sheet size, depending on the output value from the sensor 321.

Next, with reference to FIG. 2B, a configuration of the sensor 322 will be described. The sensor 322 is a sliding type sensor that includes a sensor body 312*a* and a shaft member 312*b*. The shaft member 312*b* is supported by the sensor body 312*a* such that the shaft member 312*b* can slide. The sensor body 312*a* houses a resistor (not illustrated), and converts a resistance value of the resistor to a voltage and outputs the voltage. The output voltage, which is an output value from the sensor 322, changes in accordance with the amount of movement of the shaft member 312*b* in a range between L and L' in the width direction of the sensor body 312*a*. The sensor body 312*a* has a projection 313 formed on a surface of the sensor body 312*a* opposite to a surface from which the shaft member 312*b* projects. The projection 313 is provided for easily attaching the sensor 322 in assembly work. In the present disclosure, the control unit 60 determines the sheet size, depending on the output value from the sensor 322.

In a conventional image forming apparatus, since a detection device to detect the sheet size is disposed below the tray that supports sheets, paper dust and foreign substance enters the detection device, causing damages of the detection device and wrong detection of the sheet size. In the present disclosure, however, a sensor unit 302 can prevent the damage of the detection device and the wrong detection of the sheet size. Hereinafter, the sensor unit 302 will be described. Note that an identical component is given an identical symbol in the embodiments of the present disclosure.

In addition, although the sensor 321 and 322 illustrated in FIG. 2A or 2B uses a variable resistor as an example, the sensor 321 and 322 may use another type of sensor other than the variable resistor, as long as the output value from the sensor changes in accordance with the sheet size. For example, projections may be formed in an outer circumferential surface of a rotary disk at a predetermined pattern, and a plurality of switches that detects the projections may be provided as a sensor. In this case, the ON/OFF pattern of the switches may change in accordance with a rotation angle of the disk. Thus, if the disk rotates in accordance with the movement of the regulation plate 301 (FIG. 1), the sheet size can be identified from the ON/OFF pattern of the plurality of switches. That is, the sensor unit 302 described in the following embodiments can effectively use another type of sensor other than the variable resister, unless the other sensor cannot be disposed in the sensor unit 302 due to its structure.

First Embodiment

Figure 3A:
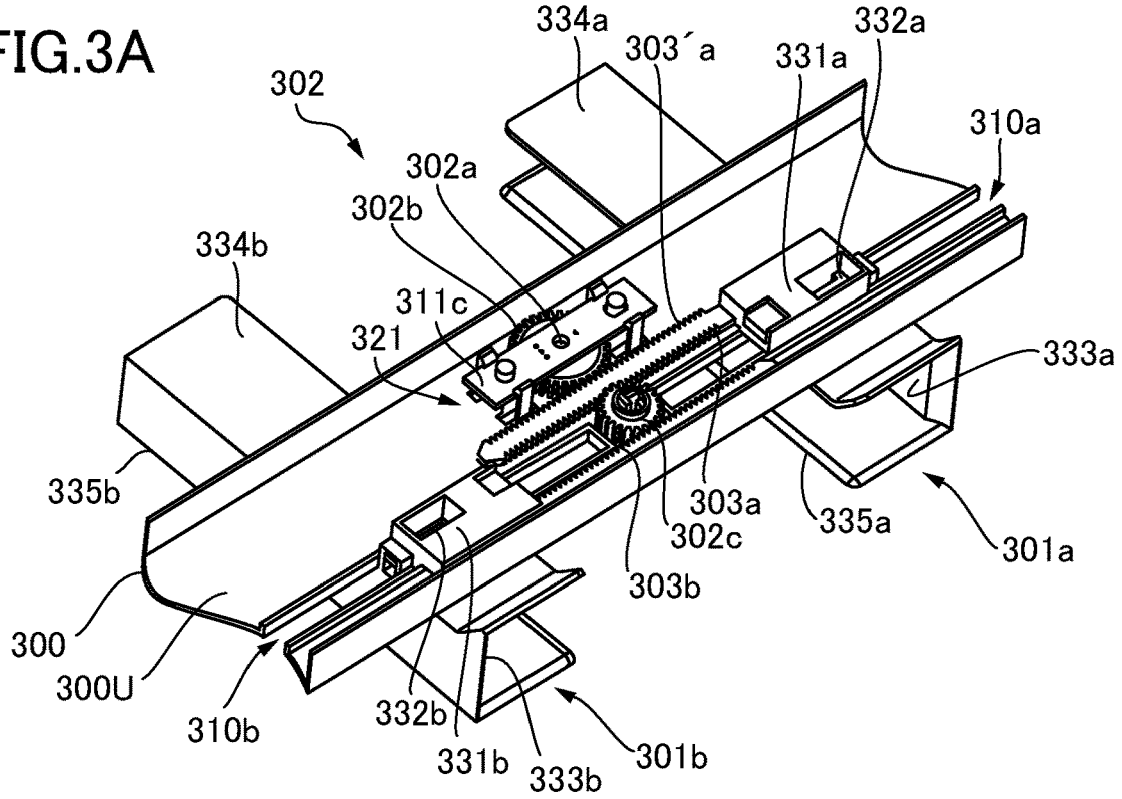
FIG. 3A is a perspective view viewed from above and illustrating a configuration of a sensor unit of a first embodiment.
Figure 3B:
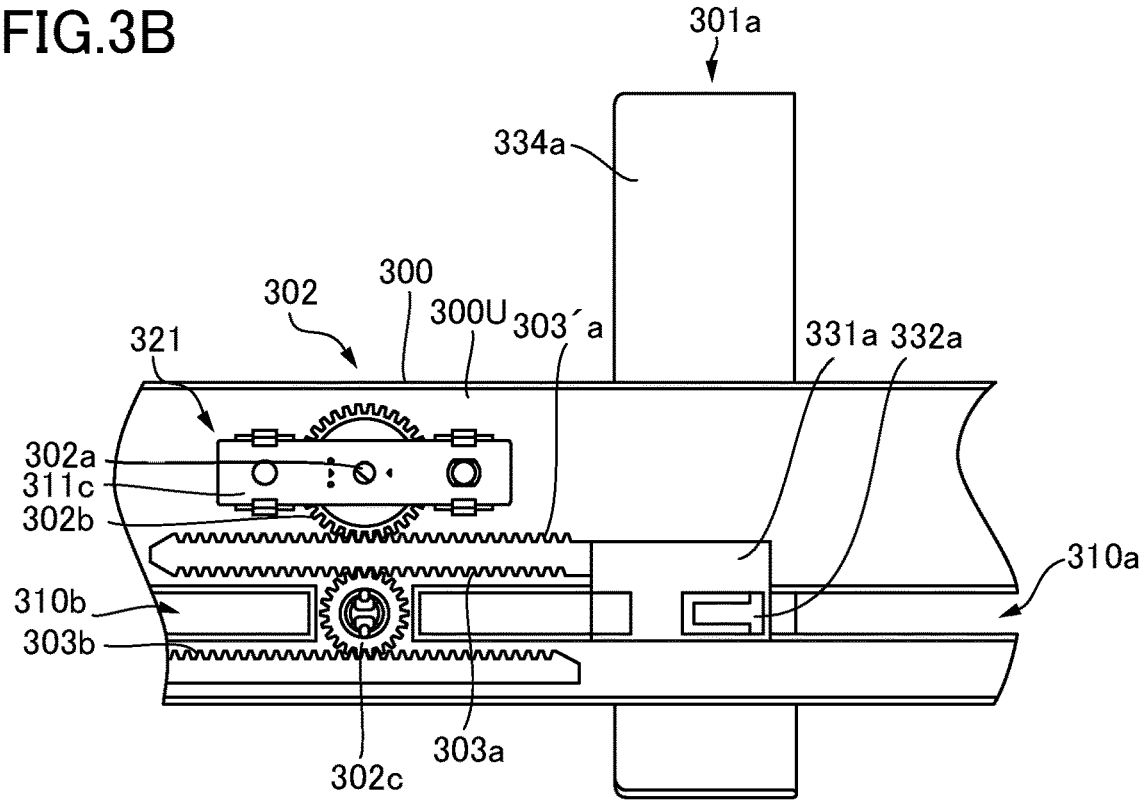
FIG. 3B is a top view illustrating the configuration of the sensor unit of the first embodiment.

FIGS. 3A and 3B illustrate a sensor unit 302 of a first embodiment. FIG. 3A is a perspective view viewed from above and illustrating a configuration of the sensor unit 302 of the present embodiment. FIG. 3B is a top view illustrating the configuration of the sensor unit 302 of the present embodiment. The sensor unit 302 of the present embodiment includes a sensor 321, a base member 300, and a size-detecting pinion 302*b*. The sensor 321 is a rotary sensor (see FIG. 2A). The sensor 321 and the size-detecting pinion 302*b* are supported by a top surface 300U of the base member 300. The top surface 300U is a surface of the base member 300 opposed to a surface facing the sheet, supported by the feeding tray 101 (see FIG. 1). The sensor 321 and the size-detecting pinion 302*b* are attached to the base member 300 such that the shaft member 311*b* (see FIG. 2A) rotates in phase with the size-detecting pinion 302*b*. Thus, the size-detecting pinion 302*b* rotates together with the shaft member 311*b*, and serves as a rotary member of the present embodiment. The size-detecting pinion 302*b* is attached to the top surface 300U of the base member 300 such that the size-detecting pinion 302*b* is sandwiched between the base member 300 and the board 311*c*. Note that the board 311*c* may be disposed with the pattern surface 31*c* facing downward, so that the pattern surface 31*c* and the size-detecting pinion 302*b* face each other.

As illustrated in FIG. 3A, the regulation plate 301*a* is U-shaped in a cross section, and has a top plate 334*a* joined with the upper edge of a regulation portion 333*a* and a bottom plate 335*a* joined with the lower edge of the regulation portion 333*a*. Similarly, the regulation plate 301*b* is U-shaped in a cross section, and has a top plate 334*b* joined with the upper edge of a regulation portion 333*b* and a bottom plate 335*b* joined with the lower edge of the regulation portion 333*b*. The base member 300 is disposed above the top plates 334*a* and 334*b* of the regulation plates 301*a* and 301*b* in the gravity direction, that is, above the regulation portions 333*a* and 333*b* in the gravity direction. The base member 300 has grooves 310*a* and 310*b* formed along the moving direction of the regulation plates 301*a* and 301*b*. The grooves 310*a* and 310*b* pass through the base member 300 in the gravity direction, and extend in a direction parallel to the moving direction of the regulation plates 301*a* and 301*b*. If the regulation portions 333*a* and 333*b* have an identical height in the gravity direction, the base member 300 is disposed on a horizontal plane higher than the top surface of the regulation portions 333*a* and 333*b* in the gravity direction. Thus, the sensor 321 is disposed such that the pattern surface 31*c* of the board 311*c* extends along a horizontal plane higher than the top surface of the regulation portions 333*a* and 333*b* in the gravity direction. That is, the sensor 321 is disposed above the feeding tray 101 (FIG. 1) and the regulation portions 333*a* and 333*b* in the gravity direction, and above the abutment position between the sheets supported by the feeding tray 101 and the pickup roller 102 in the gravity direction. The regulation plate 301*a* has a first portion 331*a* supported by the top surface 300U of the base member 300, with the groove 310*a* interposed between the first portion 331*a* and the regulation portion 333*a*. Similarly, the regulation plate 301*b* has a first portion 331*b* supported by the top surface 300U of the base member 300, with the groove 310*b* interposed between the first portion 331*b* and the regulation portion 333*b*.

Next, the arrangement of the regulation plates 301*a* and 301*b* with respect to the grooves 310*a* and 310*b* in the present embodiment will be described. First, the arrangement of the regulation plate 301*a* with respect to the groove 310*a* will be described as an example. The regulation plate 301*a* serves as a first regulation unit of the present embodiment, and includes the first portion 331*a* and the regulation portion 333*a*. The first portion 331*a* is supported by the top surface 300U of the base member 300. The regulation portion 333*a* is disposed below the base member 300, and serves as a first regulation portion that regulates the position of one edge of each sheet. The first portion 331*a* and the regulation portion 333*a* are linked with each other via a third portion 332*a* disposed in the groove 310*a*. The regulation portion 333*a* may have an uneven or flat surface. The surface contacts one edge of each sheet, and serves as a regulation surface that regulates the position of one edge of each sheet.

In such a configuration, the regulation portion 333*a* is disposed so as to be hung from the base member 300. The arrangement of the regulation plate 301*b* with respect to the groove 310*b* is the same as the arrangement of the regulation plate 301*a* with respect to the groove 310*a*. That is, the regulation plate 301*b* serves as a second regulation unit of the present embodiment, and includes the first portion 331*b*, the regulation portion 333*b*, and a third portion 332*b*. The regulation portion 333*b* is disposed below the base member 300, and serves as a second regulation portion that regulates the position of the other edge of each sheet. Thus, the regulation portions 333*a* and 333*b* are disposed below the base member 300, and face each other.

The first portion 331*a* is provided with a first rack 303*a* and a third rack 303′*a* that extend along the moving direction of the regulation plate 301*a*. In addition, the first portion 331*b* is provided with a second rack 303*b* that extends along the moving direction of the regulation plate 301*b*. The second rack 303*b* faces the first rack 303*a*. Furthermore, a regulation-plate interlocking pinion 302*c* is disposed between the first rack 303*a* and the second rack 303*b*, and meshes with the first rack 303*a* and the second rack 303*b*. In such a configuration, when the regulation plate 301*a* is moved, the regulation-plate interlocking pinion 302*c* is rotated by the movement of the first rack 303*a*, and the regulation plate 301*b* is moved by the rotation of the regulation-plate interlocking pinion 302*c*. That is, the regulation plates 301*a* and 301*b* move with each other.

In addition, when the regulation plate 301*a* is moved, the first rack 303*a* and the third rack 303'*a* are moved, and the size-detecting pinion 302*b* that meshes with the third rack 303'*a* is rotated. As described with reference to FIG. 2A, the resistance value of the resistor of the sensor 321 changes in accordance with the angle of the shaft member 311*b*. Since the shaft member 311*b* is mounted so as to rotate in phase with the size-detecting pinion 302*b*, the output value from the sensor 321 changes in accordance with the rotation angle of the size-detecting pinion 302*b*. Thus, the control unit 60 can determine the size of sheets regulated by the regulation plates 301*a* and 301*b*, depending on the output value from the sensor 321.

As described above, the sensor unit 302 of the present embodiment is disposed above the regulation portions 333*a* and 333*b* in the gravity direction, with the grooves 310*a* and 310*b* of the base member 300 being interposed between the sensor unit 302 and the regulation portions 333*a* and 333*b*. Thus, the paper dust and the foreign substance will pass through the grooves 310*a* and 310*b* and not reach the sensor unit 302. As a result, the paper dust and the foreign substance are suppressed from entering the sensor unit 302, unlike the configuration in which the sensor unit 302 is disposed below the regulation portions 333*a* and 333*b* and the feeding tray 101. Since the paper dust and the foreign substance is suppressed from adhering to the sensor 321, the damage of the sensor 321 and the wrong detection of sheet size by the sensor 321 can be reduced. In addition, in the present embodiment, since the base member 300 and the sensor 321 are disposed on a horizontal plane higher than the top surface of the regulation portions 333*a* and 333*b*, the thickness of the feeding tray 101 can be increased in the gravity direction. Consequently, the number of sheets supported by the feeding tray 101 can be increased.

Note that the size-detecting pinion 302*b* may be rotated not by the movement of the regulation plate 301*a*, but by the movement of the regulation plate 301*b*. In addition, the base member 300 may be disposed on a plane that is higher than the top surface of the regulation portions 333*a* and 333*b*, and that extends along the gravity direction and the moving direction of the regulation plates 301*a* and 301*b*. The plane that extends along the gravity direction and the moving direction of the regulation plates 301*a* and 301*b* is a plane that extends in parallel with the gravity direction and the moving direction of the regulation plates 301*a* and 301*b*. In this case, the sensor 321 and the size-detecting pinion 302*b* are mounted to the base member 300 such that the axis of the shaft member 311*b* and the axis 302*a* of the size-detecting pinion 302*b* are orthogonal to the gravity direction and the moving direction of the regulation plates 301*a* and 301*b*. The direction orthogonal to the gravity direction and the moving direction of the regulation plates 301*a* and 301*b* is a direction perpendicular to the gravity direction and the moving direction of the regulation plates 301*a* and 301*b*. In such a configuration, since the base member 300 and the board 311*c* are disposed so as to extend along the gravity direction and the moving direction of the regulation plates 301*a* and 301*b*, an area for disposing the sensor unit 302 can be reduced in a plan view.

Second Embodiment

Figure 4:
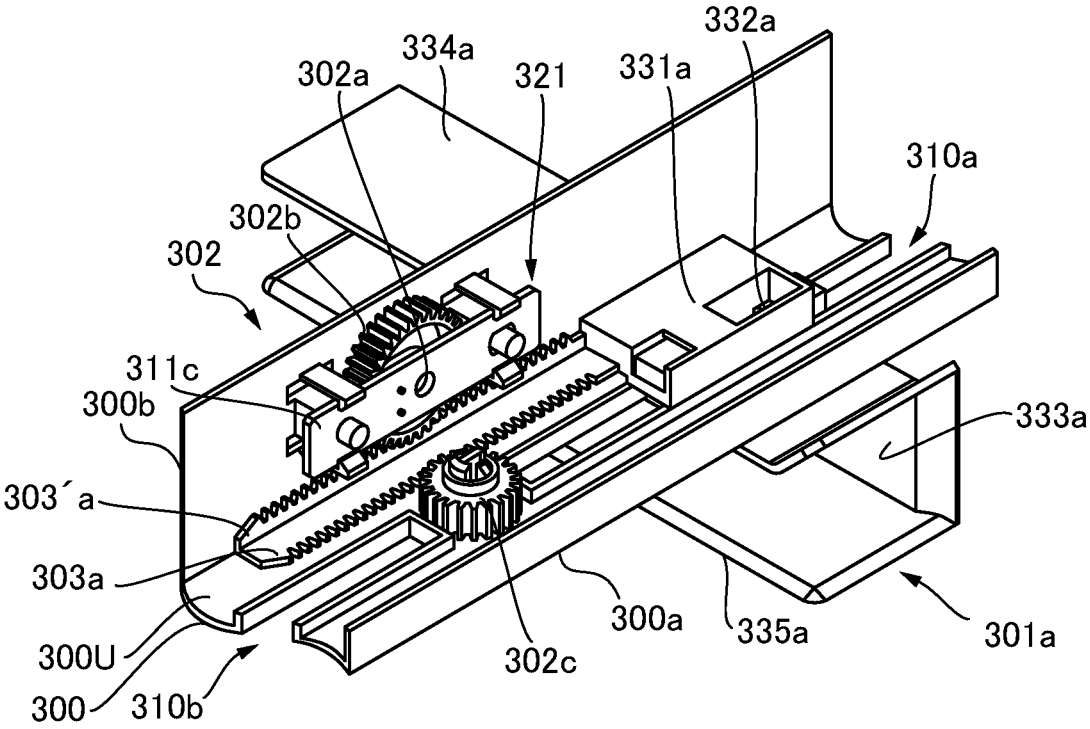
FIG. 4 is a perspective view viewed from above and illustrating a configuration of a sensor unit of a second embodiment.

FIG. 4 is a perspective view viewed from above and illustrating a configuration of a sensor unit 302 of a second embodiment. Since a regulation plate 301*b* and a groove 310*b* of the present embodiment are disposed as in the first embodiment (see FIGS. 3A and 3B), the groove 310*b* and the regulation plate 301*b* of the sensor unit 302 are not illustrated in FIG. 4. The sensor unit 302 of the present embodiment includes a sensor 321, a base member 300, and a size-detecting pinion 302*b*. The base member 300 is disposed on a horizontal plane higher than the top surface of regulation portions 333*a* and 333*b*. The base member 300 includes a first plate 300*a* and a second plate 300*b*. The first plate 300*a* is disposed on a horizontal plane, and the second plate 300*b* extends upward from the first plate 300*a* in the gravity direction. That is, the base member 300 includes the first plate 300*a* disposed on a horizontal plane higher than the top surface of the regulation portions 333*a* and 333*b* (see FIG. 3A), and the second plate 300*b* bent by 90° with respect to the first plate 300*a* and extending upward from the first plate 300*a* in the gravity direction. Thus, the second plate 300*b* extends along the gravity direction and the moving direction of the regulation plates 301*a* and 301*b*. The direction along the gravity direction and the moving direction of the regulation plates 301*a* and 301*b* is a direction parallel to the gravity direction and the moving direction of the regulation plates 301*a* and 301*b*.

The sensor 321 is a rotary sensor (see FIG. 2A). The sensor 321 and the size-detecting pinion 302*b* are supported by the second plate 300*b*. That is, the sensor 321 is disposed above the feeding tray 101 (FIG. 1) and the regulation portions 333*a* and 333*b* in the gravity direction, and above the abutment position (FIG. 1) between the sheets supported by the feeding tray 101 and the pickup roller 102 in the gravity direction. The sensor 321 and the size-detecting pinion 302*b* are attached to the base member 300 such that the shaft member 311*b* (see FIG. 2A) rotates in phase with the size-detecting pinion 302*b*. Specifically, the sensor 321 and the size-detecting pinion 302*b* are mounted to the second plate 300*b* such that the axis of the shaft member 311*b* and the axis 302*a* of the size-detecting pinion 302*b* extend in a direction orthogonal to the gravity direction and the moving direction of the regulation plates 301*a* and 301*b*. The direction orthogonal to the gravity direction and the moving direction of the regulation plates 301*a* and 301*b* is a direction perpendicular to the gravity direction and the moving direction of the regulation plates 301*a* and 301*b*. The board 311*c* is disposed on the second plate 300*b* such that the pattern surface extends along the gravity direction and the moving direction of the regulation plates 301*a* and 301*b*. Thus, the board 311*c* is disposed parallel to the gravity direction and the moving direction of the regulation plates 301*a* and 301*b*. The size-detecting pinion 302*b* rotates together with the shaft member 311*b*, and serves as a rotary member of the present embodiment. The first plate 300*a* has grooves 310*a* and 310*b* formed along the moving direction of the regulation plates 301*a* and 301*b*. The direction along the moving direction of the regulation plates 301*a* and 301*b* is a direction parallel to the moving direction of the regulation plates 301*a* and 301*b*. The regulation plate 301*a* has a first portion 331*a* supported by the top surface of the first plate 300*a*, with the groove 310*a* interposed between the first portion 331*a* and a regulation portion 333*a*. Similarly, the regulation plate 301*b* has a first portion 331*b* supported by the top surface of the first plate 300*a*, with the groove 310*b* interposed between the first portion 331*b* and a regulation portion 333*b*. The grooves 310*a* and 310*b* pass through the first plate 300*a* in the gravity direction, and extend in a direction parallel to the moving direction of the regulation plates 301*a* and 301*b*.

Next, the arrangement of the regulation plates 301*a* and 301*b* with respect to the grooves 310*a* and 310*b* in the present embodiment will be described. First, the arrangement of the regulation plate 301*a* with respect to the groove 310*a* will be described as an example. The regulation plate 301*a* serves as a first regulation unit of the present embodiment, and includes the first portion 331*a* and the regulation portion 333*a*. The first portion 331*a* is supported by the top surface of the first plate 300*a*. The regulation portion 333*a* is disposed below the first plate 300*a*, and includes in a second portion that regulates the position of one edge of each sheet. The first portion 331*a* and the regulation portion 333*a* are linked with each other via a third portion 332*a* disposed in the groove 310*a*.

In such a configuration, the regulation portion 333*a* is disposed so as to be hung from the base member 300. The arrangement of the regulation plate 301*b* with respect to the groove 310*b* is the same as the arrangement of the regulation plate 301*a* with respect to the groove 310*a*. That is, the regulation plate 301*b* serves as a second regulation unit of the present embodiment, and includes the first portion 331*b*, the regulation portion 333*b*, and a third portion 332*b* (see FIGS. 3A and 3B). Thus, the regulation portions 333*a* and 333*b* are disposed below the base member 300, and face each other. In the present embodiment, the regulation portion 333*a* serves as a first regulation portion, and the regulation portion 333*b* serves as a second regulation portion.

The first portion 331*a* is provided with a first rack 303*a* and a third rack 303'*a* that extend along the moving direction of the regulation plate 301*a*. As illustrated in FIG. 4, the first rack 303*a* extends along the first plate 300*a*, and the third rack 303'*a* extends along the second plate 300*b*. In addition, the first portion 331*b* is provided with a second rack 303*b* that extends along the moving direction of the regulation plate 301*b* (see FIGS. 3A and 3B). The second rack 303*b* faces the first rack 303*a*.

A regulation-plate interlocking pinion 302*c* that is a pinion of the present embodiment is disposed on the top surface of the first plate 300*a*, and between the first rack 303*a* and the second rack 303*b*. The regulation-plate interlocking pinion 302*c* meshes with the first rack 303*a* and the second rack 303*b*, and rotates on its axis that extends along the gravity direction. The direction of the axis of the regulation-plate interlocking pinion 302*c* that extends along the gravity direction is a direction parallel to the gravity direction. In such a configuration, when the regulation plate 301*a* is moved, the regulation-plate interlocking pinion 302*c* is rotated by the movement of the first rack 303*a*, and the regulation plate 301*b* is moved by the rotation of the regulation-plate interlocking pinion 302*c*. That is, the regulation plates 301*a* and 301*b* move with each other.

In addition, when the regulation plate 301*a* is moved, the first rack 303*a* and the third rack 303'*a* are moved, and the size-detecting pinion 302*b* that meshes with the third rack 303'*a* is rotated. As described with reference to FIG. 2A, the resistance value of the resistor of the sensor 321 changes in accordance with the angle of the shaft member 311*b*. Since the shaft member 311*b* is mounted so as to rotate in phase with the size-detecting pinion 302*b*, the output value from the sensor 321 changes in accordance with the rotation angle of the size-detecting pinion 302*b*. Thus, the control unit 60 can determine the size of sheets regulated by the regulation plates 301*a* and 301*b*, depending on the output value from the sensor 321.

As described above, the sensor unit 302 of the present embodiment is disposed above the regulation portions 333*a* and 333*b* in the gravity direction, with the grooves 310*a* and 310*b* of the base member 300 being interposed between the sensor unit 302 and the regulation portions 333*a* and 333*b*. Thus, the paper dust and the foreign substance will pass through the grooves 310*a* and 310*b* and not reach the sensor unit 302. As a result, the paper dust and the foreign substance are suppressed from entering the sensor unit 302, unlike the configuration in which the sensor unit 302 is disposed below the regulation portions 333*a* and the 333*b* and the feeding tray 101. Since the paper dust and the foreign substance is suppressed from adhering to the sensor 321, the damage of the sensor 321 and the wrong detection of sheet size by the sensor 321 can be reduced. In addition, since the sensor unit 302 is disposed on the second plate 300*b* that extends along the gravity direction and the moving direction of the regulation plates 301*a* and 301*b*, an area for disposing the sensor unit 302 can be reduced in a plan view. The direction along the gravity direction and the moving direction of the regulation plates 301*a* and 301*b* is a direction parallel to the gravity direction and the moving direction of the regulation plates 301*a* and 301*b*.

Third Embodiment

Figure 5:
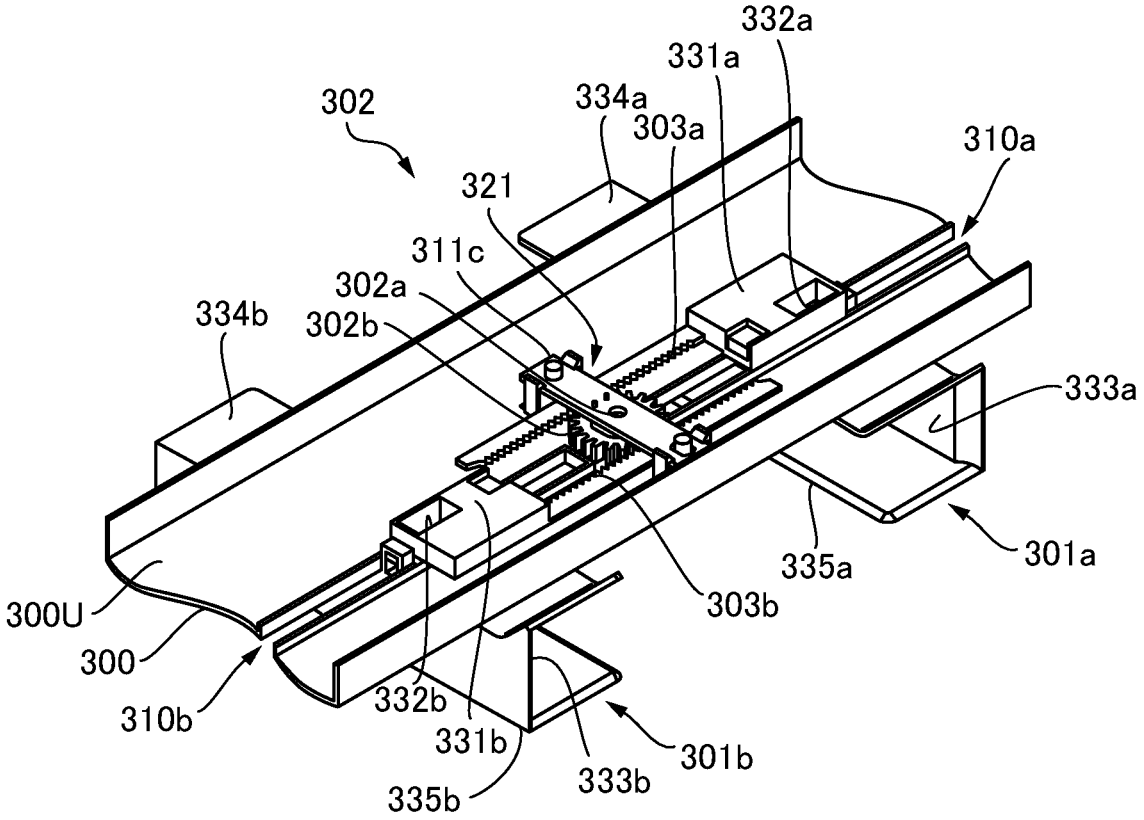
FIG. 5 is a perspective view viewed from above and illustrating a configuration of a sensor unit of a third embodiment.

FIG. 5 is a perspective view viewed from above and illustrating a configuration of a sensor unit 302 of a third embodiment. The sensor unit 302 of the present embodiment includes a sensor 321, a base member 300, and a size-detecting pinion 302*b*. The base member 300 and grooves 310*a* and 310*b* are the same in configuration and arrangement, as those of the first embodiment; and the arrangement of regulation plates 301*a* and 301*b* with respect to the grooves 310*a* and 310*b* is also the same as that of the first embodiment. Thus, duplicated description thereof will be omitted. In the present embodiment, a first portion 331*a* is provided with a first rack 303*a* that extends along the moving direction of the regulation plate 301*a*, and a first portion 331*b* is provided with a second rack 303*b* that extends along the moving direction of the regulation plate 301*b*. The second rack 303*b* faces the first rack 303*a*.

The sensor 321 is a rotary sensor. The sensor 321 and the size-detecting pinion 302*b* are supported by a top surface 300U of the base member 300 such that the pattern surface 31*c* (see FIG. 2A) of the board 311*c* is disposed on a horizontal plane. That is, the sensor 321 is disposed above the feeding tray 101 (FIG. 1) and the regulation portions 333*a* and 333*b* in the gravity direction, and above the abutment position (FIG. 1) between the sheets supported by the feeding tray 101 and the pickup roller 102 in the gravity direction. The sensor 321 and the size-detecting pinion 302*b* are attached to the base member 300 such that the axis of the shaft member 311*b* (see FIG. 2A) and the axis 302*a* of the size-detecting pinion 302*b* extend along the gravity direction, and that the shaft member 311*b* rotates in phase with the size-detecting pinion 302*b*. The size-detecting pinion 302*b* meshes with the first rack 303*a* and the second rack 303*b*. Thus, the size-detecting pinion 302*b* serves as a rotary member of the present embodiment. The size-detecting pinion 302*b* is attached to the top surface 300U of the base member 300 such that the size-detecting pinion 302*b* is sandwiched between the base member 300 and the board 311*c*. In addition, the size-detecting pinion 302*b* is disposed on the top surface 300U of the base member 300, and between the first rack 303*a* and the second rack 303*b* so as to mesh with the first rack 303*a* and the second rack 303*b*.

In such a configuration, when the regulation plate 301*a* is moved, the size-detecting pinion 302*b* is rotated by the movement of the first rack 303*a*, and the second rack 303*b* and the regulation plate 301*b* are moved by the rotation of the size-detecting pinion 302*b*. That is, the regulation plates 301*a* and 301*b* move with each other. In addition, when the regulation plate 301*a* is moved, the first rack 303*a* is moved, and the size-detecting pinion 302*b* is rotated. As described with reference to FIG. 2A, the resistance value of the resistor of the sensor 321 changes in accordance with the angle of the shaft member 311*b*. Since the shaft member 311*b* is mounted so as to rotate in phase with the size-detecting pinion 302*b*, the output value from the sensor 321 changes in accordance with the rotation angle of the size-detecting pinion 302*b*. Thus, the control unit 60 can determine the size of sheets regulated by the regulation plates 301*a* and 301*b*, depending on the output value from the sensor 321.

As described above, the sensor unit 302 of the present embodiment is disposed above the regulation portions 333*a* and 333*b* in the gravity direction, with the grooves 310*a* and 310*b* of the base member 300 being interposed between the sensor unit 302 and the regulation portions 333*a* and 333*b*. Thus, the paper dust and the foreign substance will pass through the grooves 310*a* and 310*b* and not reach the sensor unit 302. As a result, the paper dust and the foreign substance are suppressed from entering the sensor unit 302, unlike the configuration in which the sensor unit 302 is disposed below the regulation portions 333*a* and 333*b* and the feeding tray 101. In addition, since the sensor unit 302 not only allows the size-detecting pinion 302*b* to change the output value of the sensor 321, but also moves the regulation plates 301*a* and 301*b*, the number of components of the sensor unit 302 can be reduced.

Fourth Embodiment

Figure 6A:
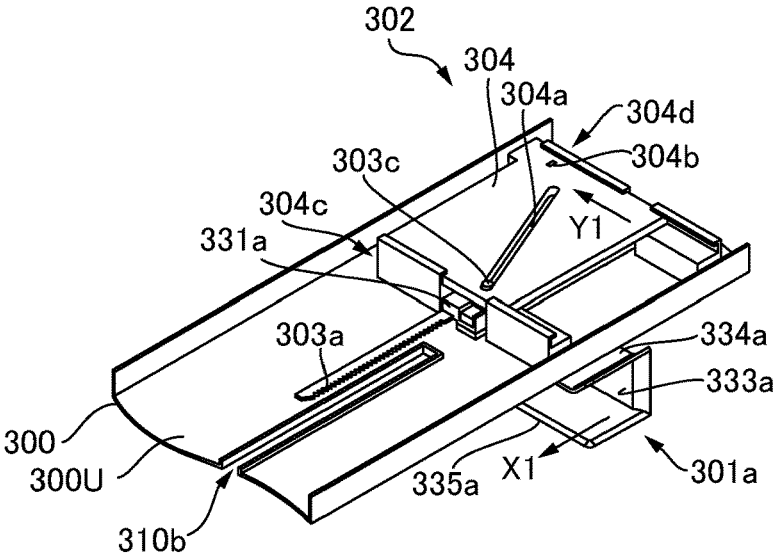
FIG. 6A is a perspective view viewed from above and illustrating a configuration of a sensor unit of a fourth embodiment, in a state where a regulation plate is moved.
Figure 6B:
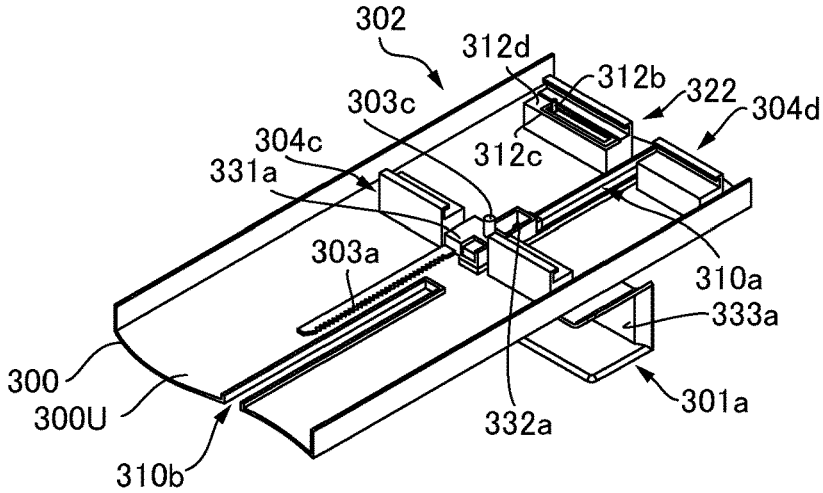
FIG. 6B is a perspective view viewed from above and illustrating the configuration of the sensor unit of the fourth embodiment, in which a slider is not illustrated.
Figure 6C:
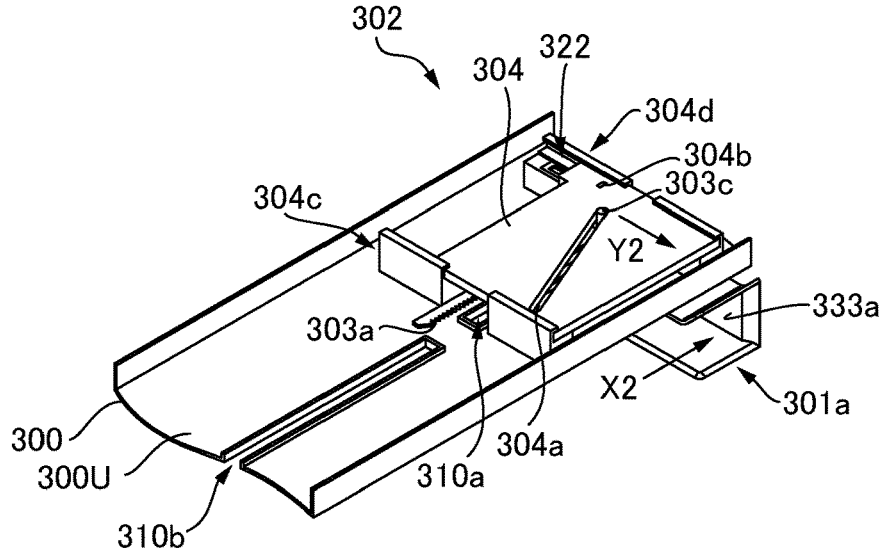
FIG. 6C is a perspective view viewed from above and illustrating the configuration of the sensor unit of the fourth embodiment, in a state where the regulation plate is moved in an opposite direction.

FIGS. 6A, 6B, and 6C illustrate a configuration of a sensor unit 302 of a fourth embodiment. FIG. 6A is a perspective view viewed from above and illustrating the configuration of the sensor unit 302 in a state where a regulation plate 301*a* is moved. FIG. 6B is a perspective view viewed from above and illustrating the configuration of the sensor unit 302, in which a slider 304 of FIG. 6A is not illustrated. FIG. 6C is a perspective view viewed from above and illustrating the configuration of the sensor unit 302 in a state where the regulation plate 301*a* is moved in a direction opposite to the direction illustrated in FIG. 6A. The sensor unit 302 of the present embodiment includes a sensor 322, a base member 300, and the slider 304. The regulation plate 301*a* includes a first portion 331*a* and a regulation portion 333*a*. The first portion 331*a* is supported by a top surface 300U of the base member 300. The regulation portion 333*a* is disposed below the base member 300, includes in a second portion, and regulates the position of one edge of each sheet. The first portion 331*a* has a boss portion 303*c* that is a projecting portion of the present embodiment. The first portion 331*a* and the regulation portion 333*a* are linked with each other via a third portion 332*a* disposed in the groove 310*a*. In such a configuration, the regulation portion 333*a* is disposed so as to be hung from the base member 300.

The base member 300 has a pair of supporting members 304*c* and 304*d*, and the groove 310*a*. The pair of supporting members 304*c* and 304*d* is used to move the slider 304 in a direction orthogonal to the gravity direction and the moving direction of the regulation plate 301*a*. The groove 310*a* extends along the moving direction of the regulation plate 301*a*. The direction orthogonal to the gravity direction and the moving direction of the regulation plate 301*a* is a direction perpendicular to the gravity direction and the moving direction of the regulation plate 301*a*. In addition, the direction along the moving direction of the regulation plate 301*a* is a direction parallel to the moving direction of the regulation plate 301*a*. The supporting members 304*c* and 304*d* are disposed on the top surface 300U of the base member 300, and the slider 304 is supported by the supporting members 304*c* and 304*d* such that the slider 304 can move along a horizontal plane. The sensor 322 is a slide sensor (see FIG. 2B). On the supporting member 304*d*, a board 312*c* on which the sensor 322 is fixed is disposed. The board 312*c* has a pattern surface 312*d* that extends along a horizontal plane. Thus, the sensor 322 is mounted on the supporting member 304*d* such that a sensor body 312*a* is electrically connected to the pattern surface 312*d* of the board 312*c*. In addition, the sensor 322 is mounted on the supporting member 304*d* such that a shaft member 312*b*, which is a slide member of the present embodiment, moves in a direction orthogonal to the gravity direction and the moving direction of the regulation plate 301*a* (see FIG. 6B). That is, the sensor 322 is disposed above the feeding tray 101 (FIG. 1) and the regulation portion 333*a* in the gravity direction, and above the abutment position (FIG. 1) between the sheets supported by the feeding tray 101 and the pickup roller 102 in the gravity direction. The slider 304 has a groove portion 304*a* that engages with the boss portion 303*c*, and an engagement portion 304*b* that engages with the shaft member 312*b* of the sensor 322. The direction in which the groove portion 304*a* extends has an angle with respect to the moving direction of the regulation plate 301*a* (i.e. sheet width direction) so that the slider 304 moves in a predetermined direction (Y1 direction) perpendicular to the moving direction and the gravity direction.

In such a configuration, when the regulation plate 301*a* moves in an X1 direction in a state where the boss portion 303*c* engages with the groove portion 304*a*, the boss portion 303*c* slides along the groove portion 304*a*, and the slider 304 moves in the Y1 direction (FIG. 6A). On the other hand, when the regulation plate 301*a* moves in an X2 direction in the state where the boss portion 303*c* engages with the groove portion 304*a*, the boss portion 303*c* slides along the groove portion 304*a*, and the slider 304 moves in a Y2 direction (FIG. 6C). In addition, when the slider 304 moves in the Y1 or Y2 direction, the shaft member 312*b* also moves in the Y1 or Y2 direction in the state where the shaft member 312*b* engages with the engagement portion 304*b*. That is, the shaft member 312*b* moves in a direction in which the slider 304 moves. Thus, the shaft member 312*b* moves in a direction orthogonal to the gravity direction and the moving direction of the regulation plate 301*a*. Thus, the slider 304 serves as a moving member of the present embodiment, which moves the shaft member 312*b* in a direction orthogonal to the moving direction of the regulation plate 301*a*. Note that the groove portion 304*a* may not pass through the slider 304 as long as the groove portion 304*a* engages with the boss portion 303*c*. In addition, although the boss portion 303*c* is formed on the first portion 331*a* in FIGS. 6A, 6B, and 6C, the boss portion 303*c* may be formed on the slider 304, and the groove portion may be formed in the first portion 331*a* such that the boss portion of the slider 304 engages with the groove portion. That is, if the boss portion 303*c* is formed on either of the slider 304 and the first portion 331*a* and the groove portion 304*a* is formed in the other, the shaft member 312*b* can move in a direction in which the slider 304 moves.

As described with reference to FIG. 2B, the resistance value of the resistor of the sensor 322 changes in accordance with the amount of movement of the shaft member 312*b* in a range between L and L' in the width direction of the sensor body 312*a*. Since the shaft member 312*b* is mounted so as to move together with the regulation plate 301*a*, the output value from the sensor 322 changes in accordance with the amount of movement of the regulation plate 301*a*. Thus, the control unit 60 determines the amount of movement of the regulation plate 301*a*, depending on the output value from the sensor 322; and can determine the size of sheets regulated by the regulation plate 301*a*, depending on the amount of movement of the regulation plate 301*a*.

As described above, in the present embodiment, since the sensor unit 302 is disposed above the regulation portions 333*a* and 333*b* in the gravity direction, the paper dust and the foreign substance will pass through the groove 310*a* and not reach the sensor unit 302. As a result, the paper dust and the foreign substance are suppressed from entering the sensor unit 302, unlike the configuration in which the sensor unit 302 is disposed below the regulation portion 333*a* and the feeding tray 101. In addition, in the configuration in which the sheets are fed toward a direction orthogonal to the moving direction of the regulation plate 301*a*, since the sensor 322 is disposed such that the shaft member 312*b* moves in the sheet feeding direction, the space along the sheet feeding direction can be effectively used.

Although the description has been made with reference to FIGS. 6A, 6B, and 6C, for the sensor 322 used for the regulation plate 301*a* and disposed on the top surface 300U of the base member 300, the sensor unit 302 of the present embodiment may be used also for the regulation plate 301*b*. If the sensor unit 302 is disposed for each of the regulation plates 301*a* and 301*b*, the size of sheets regulated by the regulation plates 301*a* and 301*b* can be detected with higher accuracy. In addition, the regulation plate 301*a* may be disposed as a trailing edge regulation plate that regulates the position of a trailing edge of each sheet in the sheet feeding direction. In this case, a sheet size in the sheet feeding direction can be detected.

Fifth Embodiment

Figure 7:
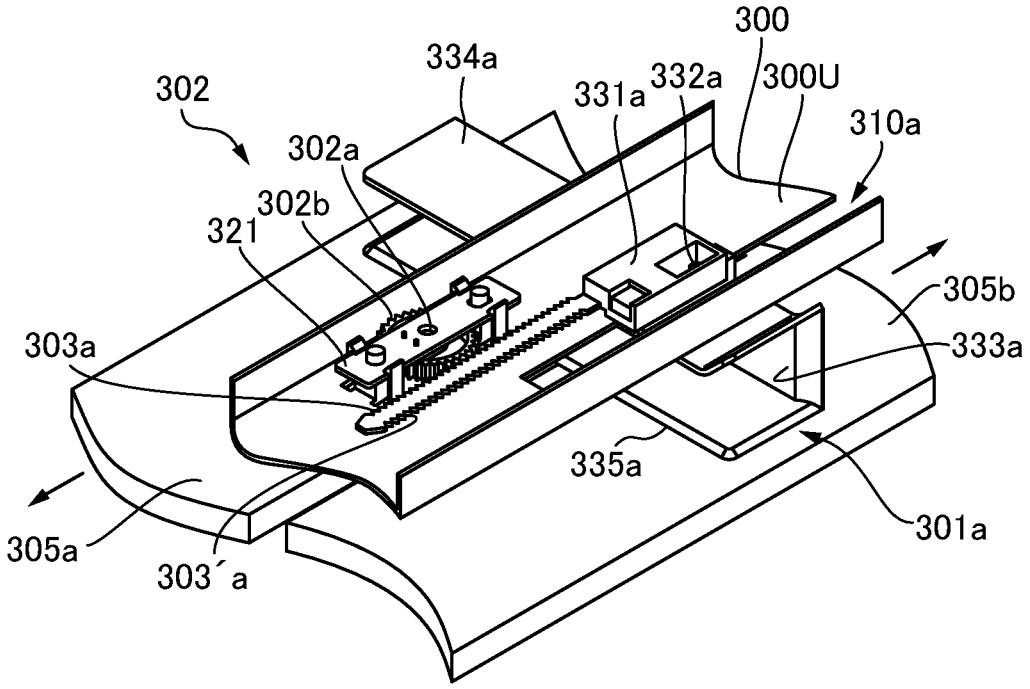
FIG. 7 is a perspective view viewed from above and illustrating a configuration of a sensor unit of a fifth embodiment.

FIG. 7 is a perspective view viewed from above and illustrating a configuration of a sensor unit 302 of a fifth embodiment. In the present embodiment, regulation plates 301*a* and 301*b* are disposed above bottom plates 305*a* and 305*b* in the gravity direction, and the sensor unit 302 of any one of the first to the third embodiments can be used. Specifically, the regulation plates 301*a* and 301*b* are disposed above the bottom plates 305*a* and 305*b* in the gravity direction, and a rack and a pinion (both not illustrated) are disposed below the bottom plates 305*a* and 305*b*. The bottom plates 305*a* and 305*b* are moved together with the regulation plate 301*a* via the rack and pinion. Thus, the regulation plate 301*b* can be moved together with the regulation plate 301*a* by moving the bottom plates 305*a* and 305*b*. In the present embodiment, a component of FIG. 7 identical to a component of the first to the third embodiments is given an identical symbol, and duplicated description thereof will be omitted. In addition, although the regulation plate 301*b*, the groove 310*b* are not illustrated in FIG. 7, these components may be the same as those of the first to the third embodiments.

In the present embodiment, when the regulation plate 301*a* is moved by moving the bottom plate 305*a*, a size-detecting pinion 302*b* is rotated as in the first to the third embodiments. That is, even when the regulation plate 301*a* is moved by moving the bottom plate 305*a*, the output value from the sensor 321 changes in accordance with the rotation angle of the size-detecting pinion 302*b*. The control unit 60 can determine the size of sheets regulated by the regulation plates 301*a* and 301*b*, depending on the output value from the sensor 321. In the present embodiment, even in the configuration in which the regulation plates 301*a* and 301*b* are moved by moving the bottom plates 305*a* and 305*b*, the sensor unit 302 including the rotary sensor 321 is disposed above the feeding tray 101 (FIG. 1) and the regulation portions 333*a* and 333*b* in the gravity direction, and above the abutment position (FIG. 1) between the sheets supported by the feeding tray 101 and the pickup roller 102 in the gravity direction. Thus, also in the present embodiment, the paper dust and the foreign substance can be suppressed from moving from the regulation portions 333*a* and 333*b* and the feeding tray 101 to the sensor unit 302 and entering the sensor unit 302. Since the paper dust and the foreign substance is suppressed from adhering to the sensor 321, the damage of the sensor 321 and the wrong detection of sheet size by the sensor 321 can be reduced.

Sixth Embodiment

Figure 8A:
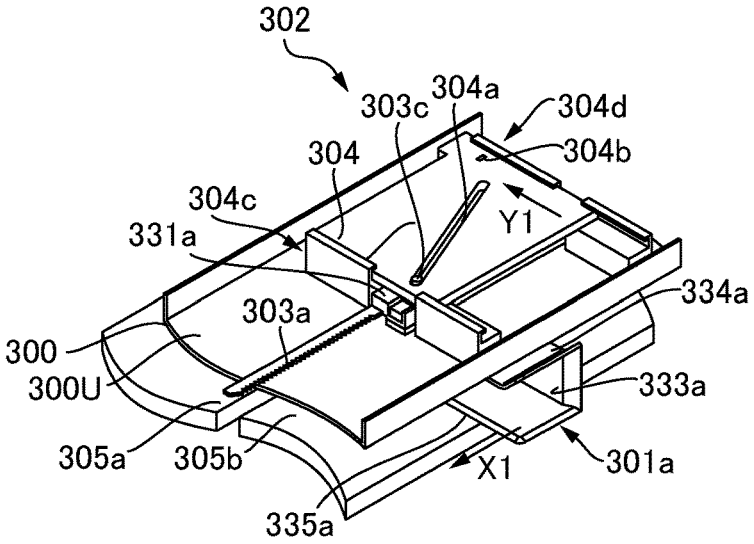
FIG. 8A is a perspective view viewed from above and illustrating a configuration of a sensor unit of a sixth embodiment, in a state where a regulation plate is moved.
Figure 8B:
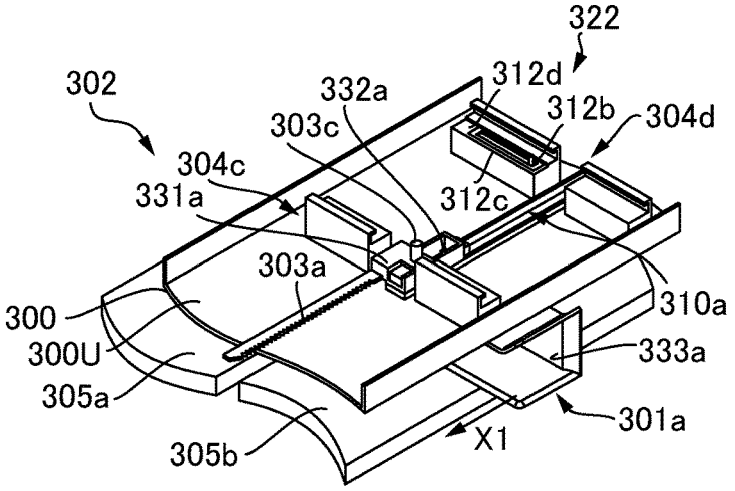
FIG. 8B is a perspective view viewed from above and illustrating the configuration of the sensor unit of the sixth embodiment, in which a slider is not illustrated.
Figure 8C:
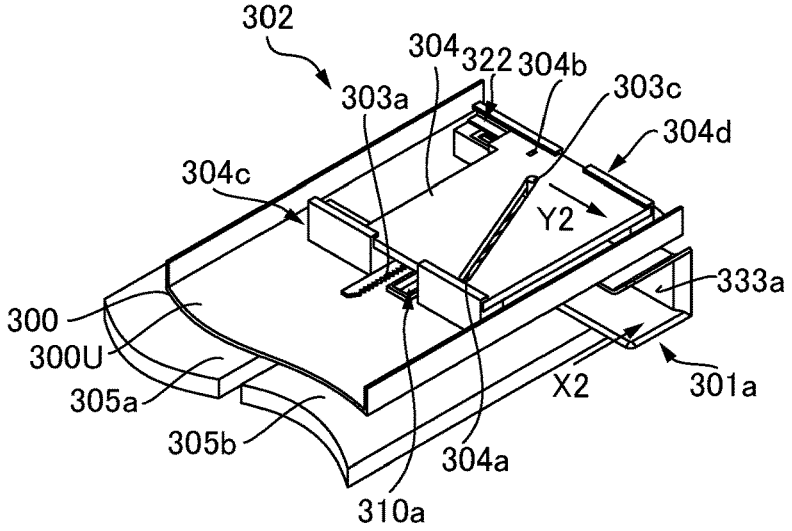
FIG. 8C is a perspective view viewed from above and illustrating the configuration of the sensor unit of the sixth embodiment, in a state where the regulation plate is moved in an opposite direction.

FIGS. 8A, 8B, and 8C are perspective views viewed from above and illustrating a configuration of a sensor unit 302 of a sixth embodiment. FIG. 8A is a perspective view viewed from above and illustrating the configuration of the sensor unit 302 in a state where a regulation plate 301*a* is moved. FIG. 8B is a perspective view viewed from above and illustrating the configuration of the sensor unit 302, in which a slider 304 of FIG. 8A is not illustrated. FIG. 8C is a perspective view viewed from above and illustrating the configuration of the sensor unit 302 in which the regulation plate 301*a* is moved in a direction opposite to the direction illustrated in FIG. 8A. In the present embodiment, the regulation plates 301*a* and 301*b* are disposed above bottom plates 305*a* and 305*b* in the gravity direction, and the sensor unit 302 of the fourth embodiment can be used. Specifically, the regulation plates 301*a* and 301*b* are disposed above the bottom plates 305*a* and 305*b* in the gravity direction, and a rack and a pinion (both not illustrated) are disposed below the bottom plates 305*a* and 305*b* in the gravity direction. The bottom plates 305*a* and 305*b* are moved together with the regulation plate 301*a* via the rack and pinion. Thus, the regulation plate 301*b* can be moved together with the regulation plate 301*a* by moving the bottom plates 305*a* and 305*b*. In the present embodiment, a component of FIG. 8 identical to a component of the fourth embodiment is given an identical symbol, and duplicated description thereof will be omitted. In addition, although the regulation plate 301*b* and the groove 310*b* are not illustrated in FIGS. 8A to 8C, these components may be the same as those of the fourth embodiment.

In the present embodiment, when the regulation plate 301*a* is moved in an X1 or X2 direction by moving the bottom plate 305*a*, the shaft member 312*b* of the sensor 322 is moved in a Y1 or Y2 direction, as in the fourth embodiment (FIGS. 8A and 8C). That is, even when the regulation plate 301*a* is moved by moving the bottom plate 305*a*, the output value from the sensor 322 changes in accordance with the amount of movement of the regulation plate 301*a*, as in the fourth embodiment. Thus, the control unit 60 determines the amount of movement of the regulation plate 301*a*, depending on the output value from the sensor 322; and can determine the size of sheets regulated by the regulation plate 301*a*, depending on the amount of movement of the regulation plate 301*a*. In the present embodiment, even in the configuration in which the regulation plates 301*a* and 301*b* are moved by moving the bottom plates 305*a* and 305*b*, the sensor unit 302 including the sensor 322 is disposed above the feeding tray 101 (FIG. 1) and the regulation portions 333*a* and 333*b* in the gravity direction, and above the abutment position (FIG. 1) between the sheets supported by the feeding tray 101 and the pickup roller 102 in the gravity direction. Thus, also in the present embodiment, the paper dust and the foreign substance can be suppressed from moving from the regulation portions 333*a* and 333*b* and the feeding tray 101 to the sensor unit 302 and entering the sensor unit 302. Since the paper dust and the foreign substance is suppressed from adhering to the sensor 322, the damage of the sensor 322 and the wrong detection of sheet size by the sensor 322 can be reduced.

Seventh Embodiment

Figure 9A:
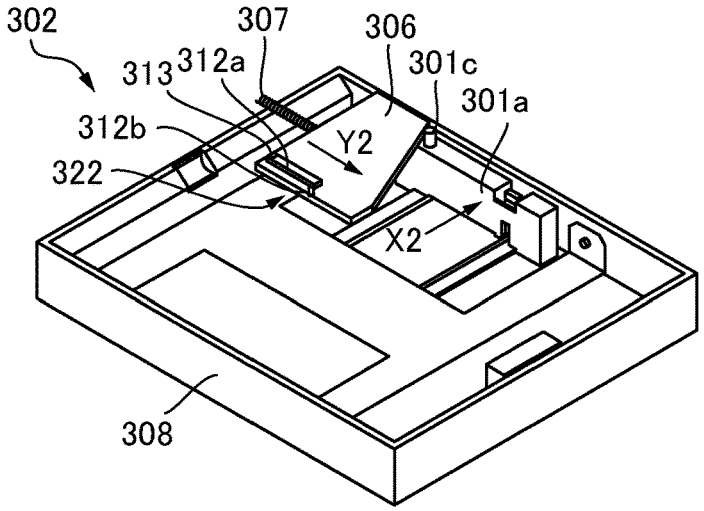
FIG. 9A is a perspective view viewed from above and illustrating a configuration of a sensor unit of a seventh embodiment, in a state where a regulation plate is moved.
Figure 9B:
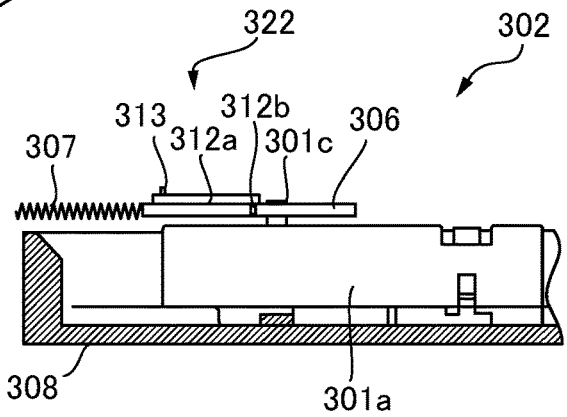
FIG. 9B is a sectional view illustrating the configuration of the sensor unit of the seventh embodiment, in the state where the regulation plate is moved.
Figure 9C:
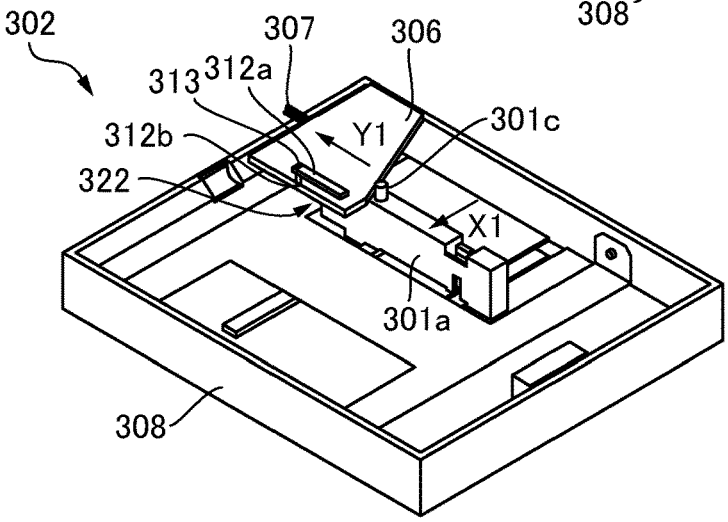
FIG. 9C is a perspective view viewed from above and illustrating the configuration of the sensor unit of the seventh embodiment, in a state where the regulation plate is moved in an opposite direction.
Figure 9D:
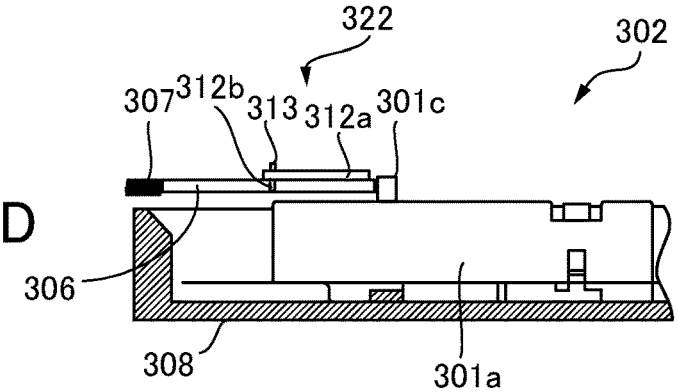
FIG. 9D is a sectional view illustrating the configuration of the sensor unit of the seventh embodiment, in the state where the regulation plate is moved in the opposite direction.

FIGS. 9A, 9B, 9C, and 9D illustrate a configuration of a seventh embodiment in which a sensor unit 302 is used in a feeding cassette 308. FIG. 9A is a perspective view viewed from above and illustrating the configuration of the sensor unit 302 in a state where a regulation plate 301*a* is moved. FIG. 9B is a sectional view of the feeding cassette 308 of FIG. 9A. FIG. 9C is a perspective view viewed from above and illustrating the configuration of the sensor unit 302 in a state where the regulation plate 301*a* is moved in a direction opposite to the direction illustrated in FIG. 9A. FIG. 9D is a sectional view of the feeding cassette 308 of FIG. 9C. The sensor unit 302 of the present embodiment includes a sensor 322 and a slider 306.

The feeding cassette 308 serves as a supporting portion of the present embodiment, and can be attached to or drawn from the apparatus body 1A (see FIG. 1). The regulation plate 301*a* is disposed in the feeding cassette 308, and can move in a direction orthogonal to a direction in which the feeding cassette 308 is attached to and drawn from the apparatus body 1A. The direction orthogonal to the direction in which the feeding cassette 308 is attached to and drawn from the apparatus body 1A is a direction perpendicular to the direction in which the feeding cassette 308 is attached to and drawn from the apparatus body 1A. The feeding direction in which the sheets are fed from the feeding cassette 308 is a direction along which the feeding cassette 308 is attached to and drawn from the apparatus body 1A, or a direction which is parallel to the direction in which the feeding cassette 308 is attached to and drawn from the apparatus body 1A. That is, the moving direction of the regulation plate 301*a* is a sheet width direction orthogonal to the feeding direction. The regulation plate 301*a* has a boss portion 301*c* formed on the top surface of the regulation plate 301*a*. The boss portion 301*c* serves as a projecting portion of the present embodiment, and engages with the slider 306. The slider 306 is urged by an urging member such as a pressing spring 307, toward a direction in which the feeding cassette 308 is drawn from the apparatus body 1A. The slider 306, the pressing spring 307, and the sensor 322 are positioned above a regulation portion 333*a* of the regulation plate 301*a* in the gravity direction, and disposed via an attachment plate (not illustrated) such that the slider 306 moves along a horizontal plane. The sensor 322 is disposed such that the shaft member 312*b* of the sensor 322, which serves as a slide member of the present embodiment, engages with a hole (not illustrated) of the slider 306, and that the sensor body 312*a* and the projection 313 can be seen from above in the gravity direction. The attachment plate has a board on which the sensor 322 is fixed. The board has a pattern surface that extends along a horizontal plane. On the pattern surface, an electric circuit is formed and electrically connected with the sensor 322. The sensor 322 is attached to the attachment plate (not illustrated) such that the sensor body 312*a* is electrically connected to the pattern surface of the board.

In the feeding cassette 308 to be attached to the apparatus body 1A, when the boss portion 301*c* engages with the slider 306 and the regulation plate 301*a* is moved in an X2 direction, the boss portion 301*c* moves along the shape of the slider 306, and the slider 306 moves in a Y2 direction (see FIG. 9A). As illustrated in FIG. 9B, when the slider 306 moves in the Y2 direction, the pressing spring 307 expands, and the shaft member 312*b* of the sensor 322 is located away from the projection 313 in the sensor body 312*a*. On the other hand, in the feeding cassette 308 to be attached to the apparatus body 1A, when the boss portion 301*c* engages with the slider 306 and the regulation plate 301*a* is moved in an X1 direction, the boss portion 301*c* moves along the shape of the slider 306 and the slider 306 moves in a Y1 direction (see FIG. 9C). As illustrated in FIG. 9C, when the slider 306 moves in the Y1 direction, the pressing spring 307 contracts, and the shaft member 312*b* of the sensor 322 is located close to the projection 313 in the sensor body 312*a*.

Thus, the slider 306 serves as a moving member of the present embodiment, which moves the shaft member 312*b* in a direction orthogonal to the gravity direction and the moving direction of the regulation plate 301*a*, in accordance with the movement of the regulation plate 301*a*. The direction orthogonal to the gravity direction and the moving direction of the regulation plate 301*a* is a direction perpendicular to the gravity direction and the moving direction of the regulation plate 301*a*. For the engagement between the slider 306 and the boss portion 301*c*, the slider 306 may have a groove portion that engages with the boss portion 301*c*, or another configuration other than the configuration illustrated in FIGS. 9A, 9B, 9C, and 9D may be used.

As described with reference to FIG. 2B, the resistance value of the resistor of the sensor 322 changes in accordance with the amount of movement of the shaft member 312*b* in the range between L and L' in the width direction of the sensor body 312*a*. Since the shaft member 312*b* is mounted so as to move together with the regulation plate 301*a*, the output value from the sensor 322 changes in accordance with the amount of movement of the regulation plate 301*a*. Thus, the control unit 60 determines the amount of movement of the regulation plate 301*a*, depending on the output value from the sensor 322, and can determine the size of sheets regulated by the regulation plate 301*a*, depending on the amount of movement of the regulation plate 301*a*. In the present embodiment, since the sensor unit 302 is disposed above the feeding cassette 308 in the gravity direction, the paper dust and the foreign substance can be suppressed from moving from the feeding cassette 308 to the sensor unit 302 and entering the sensor unit 302.

In the present embodiment, the description has been made for the configuration in which the sensor 322 is used. However, another configuration may be used. For example, a rack may be disposed on the top surface of the slider 306 along a direction in which the feeding cassette 308 is attached to and drawn from the apparatus body 1A, and a pinion that meshes with the rack and the sensor 321 may be disposed. In such a configuration, the rotary sensor 321 can be disposed above the feeding cassette 308 in the gravity direction.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-105657, filed Jun. 5, 2019, which is hereby incorporated by reference herein in its entirety.

What is claimed is:

1. A sheet feeding apparatus comprising:

a supporting portion configured to support a sheet:

a feeding portion configured to feed the sheet supported by the supporting portion;

a base member opposed to the supporting portion so that the sheet is supported by the supporting portion between the supporting portion and the base member;

a regulation unit comprising a regulation portion configured to regulate a position of an edge portion of the sheet supported by the supporting portion, the regulation unit being configured to move in a moving direction and cause the regulation portion to regulate a position of the edge portion of the sheet in the moving direction; and a sensor configured to output an output value that changes in accordance with an amount of movement of the regulation unit in the moving direction, wherein the base member is disposed above the supporting portion and the regulation portion in a gravity direction, wherein the sensor and an upper portion of the regulation unit are supported by the base member, and wherein the sensor is supported by the base member at a position above an abutment position between the sheet supported by the supporting portion and the feeding portion in the gravity direction.

2. The sheet feeding apparatus according to claim 1, wherein the base member is disposed above the supporting portion and the regulation portion comprises a groove extending along the moving direction, wherein the regulation unit comprises:

a first portion disposed above the groove and supported by the base member, a second portion comprising the regulation portion, and a third portion disposed in the groove and configured to link the first portion and the second portion.

3. The sheet feeding apparatus according to claim 2, wherein the sensor is supported by a surface of the base member opposed to a surface facing the sheet, supported by the supporting portion.

4. The sheet feeding apparatus according to claim 2, further comprising a board comprising a pattern surface on which an electric circuit is formed, the sensor being electrically connected to the electric circuit, wherein the board is disposed such that the pattern surface extends along the moving direction and the gravity direction.

5. The sheet feeding apparatus according to claim 4, wherein the sensor comprises a rotary member configured to rotate in accordance with movement of the regulation unit in the moving direction, and wherein an axis of the rotary member extends in a direction orthogonal to the gravity direction and the moving direction.

6. The sheet feeding apparatus according to claim 5, wherein the regulation unit is a first regulation unit;

wherein the sheet feeding apparatus further comprises a second regulation unit and a pinion, wherein the first regulation unit comprises the regulation portion, a first rack, and a third rack, wherein the regulation portion is a first regulation portion, wherein the first rack and the third rack extend along the moving direction, wherein the second regulation unit comprises a second regulation portion and a second rack, and is configured to move in the moving direction, wherein the second regulation portion is configured to regulate a position of another edge portion of the sheet, supported by the supporting portion, in the moving direction, wherein the second rack extends along the moving direction, wherein the pinion is configured to rotate on an axis extending along the gravity direction and mesh with the first rack and the second rack, and wherein the third rack is configured to mesh with the rotary member.

7. The sheet feeding apparatus according to claim 2, further comprising a board comprising a pattern surface on which an electric circuit is formed, the sensor being electrically connected to the electric circuit, wherein the board is disposed such that the pattern surface extends along a horizontal plane.

8. The sheet feeding apparatus according to claim 7, wherein the sensor comprises a rotary member configured to rotate in accordance with movement of the regulation unit in the moving direction, and wherein an axis of the rotary member extends along the gravity direction.

9. The sheet feeding apparatus according to claim 8, wherein the regulation unit is a first regulation unit;

wherein the sheet feeding apparatus further comprises a second regulation unit and a pinion, wherein the first regulation unit comprises the regulation portion, a first rack, and a third rack, wherein the regulation portion is a first regulation portion, wherein the first rack and the third rack extend along the moving direction, wherein the second regulation unit comprises a second regulation portion and a second rack, and is configured to move in the moving direction, wherein the second regulation portion is configured to regulate a position of another edge portion of the sheet, supported by the supporting portion, in the moving direction, wherein the second rack extends along the moving direction, wherein the pinion is configured to rotate on an axis extending along the gravity direction and mesh with the first rack and the second rack, and wherein the third rack is configured to mesh with the rotary member.

10. The sheet feeding apparatus according to claim 8, wherein the regulation unit is a first regulation unit;

wherein the sheet feeding apparatus further comprises a second regulation unit, wherein the first regulation unit comprises the regulation portion and a first rack, wherein the regulation portion is a first regulation portion, wherein the first rack extends along the moving direction, wherein the second regulation unit comprises a second regulation portion and a second rack, and is configured to move in the moving direction, wherein the second regulation portion is configured to regulate a position of another edge portion of the sheet, supported by the supporting portion, in the moving direction, wherein the second rack extends along the moving direction, and wherein the first rack and the second rack are configured to mesh with the rotary member.

11. The sheet feeding apparatus according to claim 7, wherein the sensor is a slide member configured to move in accordance with movement of the regulation unit in the moving direction.

12. The sheet feeding apparatus according to claim 11, wherein the slide member is configured to move in a direction orthogonal to the gravity direction and the moving direction.

13. The sheet feeding apparatus according to claim 12, further comprising a moving member configured to engage with the slide member, wherein one of the regulation unit and the moving member comprises a projecting portion, and another of the regulation unit and the moving member comprises a groove portion configured to engage with the projecting portion, wherein when the regulation unit is moved in the moving direction, the moving member is moved by the projecting portion sliding along the groove portion, and wherein the slide member is configured to move along a moving direction of the moving member in a state where the slide member engages with the moving member.

14. The sheet feeding apparatus according to claim 1, further comprising a control unit configured to determine a size of the sheet regulated by the regulation unit, depending on an output value from the sensor.

15. The sheet feeding apparatus according to claim 1, wherein the moving direction is a sheet width direction orthogonal to a sheet feeding direction.

16. The sheet feeding apparatus according to claim 1, wherein the regulation unit comprises a guide portion configured to guide the sheet, and wherein the guide portion is formed at an end portion of the regulation unit on an upstream side in a sheet insertion direction, and slopes downward as the guide portion extends downstream in the sheet insertion direction.

17. An image forming apparatus comprising:

the sheet feeding apparatus according to claim 1; and an image forming portion configured to form an image on a sheet fed from the sheet feeding apparatus.

* * * * *